US006001422A

United States Patent [19]

Hirai et al.

[11] Patent Number: 6,001,422

[45] Date of Patent: Dec. 14, 1999

[54] METHOD FOR FINISHING TREATMENT OF A FABRIC MATERIAL

[75] Inventors: Motohiko Hirai; Fujio Yagihashi, both of Gunma-ken, Japan

[73] Assignee: Shin-Etsu Chemical Co., Ltd., Japan

[21] Appl. No.: 09/058,162

[22] Filed: Apr. 10, 1998

[30] Foreign Application Priority Data

Apr. 11, 1997 [JP] Japan ..... 9-093659

[51] Int. Cl.[6] ..... B05D 3/02

[52] U.S. Cl. ..... 427/387; 427/389.9

[58] Field of Search ..... 427/387, 389.9

[56] References Cited

U.S. PATENT DOCUMENTS 5,212,274 5/1993 Tsukuno ..... 528/14

FOREIGN PATENT DOCUMENTS 2-047371 2/1990 Japan .
1249118 10/1971 United Kingdom .
1598845 9/1981 United Kingdom .

*Primary Examiner*—Erma Cameron
*Attorney, Agent, or Firm*—Millen, White, Zelano, & Branigan, P.C.

[57] ABSTRACT

Proposed is a method for the finishing treatment of various kinds of fabric materials with an aminoalkyl-modified dimethylpolysiloxane to impart the fabric material with excellent softness and smoothness with less disadvantages of yellowing of the treated fabric material than in the prior art using similar aminoalkyl-modified dimethylpolysiloxanes. In the inventive method, the aminoalkyl-modified dimethylpolysiloxane is represented by the general formula $$A—SiR_2—O—(—SiR_2—O—)_p—(—SiRQ—O—)_q—SiR_2—A,$$

in which R is a monovalent hydrocarbon group having 1 to 20 carbon atoms, Q is an aminoalkyl group expressed by the general formula $$—R^1—(—NH—CH_2—CH_2—)_n—NH_2,$$

$R^1$ being a divalent hydrocarbon group having 1 to 8 carbon atoms and the subscript n being 2 or 3, A is a hydroxyl group, R, OR or Q, the subscript p is an average number in the range from 5 to 2000 and the subscript q is 0 or an average number not exceeding 100 with the proviso that q is not 0 when the groups denoted by A in a molecule are each a hydroxyl group, R or OR, and having an amine equivalent in the range from 5000 to 100,000 g/mole.

17 Claims, No Drawings

METHOD FOR FINISHING TREATMENT OF A FABRIC MATERIAL

BACKGROUND OF THE INVENTION

The present invention relates to a method for the finishing treatment of a fabric material or, more particularly, to a method for the finishing treatment of a fabric material by using a silicone-containing fabric finishing agent capable of imparting the treated fabric material with excellent touch feeling of softness and smoothness as accompanied by less significant troubles of yellowing of the treated fabric material than with conventional silicone-containing fabric finishing agents.

It is a conventional prior art method widely under practice that various kinds of fabric materials are imparted with improved touch feelings of softness and smoothness by a finishing treatment using a silicone-containing fabric-finishing agent. The silicones as the principal ingredient in the prior art fabric-finishing agents include dimethylpolysiloxanes, epoxy-modified organopolysiloxanes and aminoalkyl-containing organopolysiloxanes, of which aminoalkyl-containing organopolysiloxanes are most widely employed in respect of the particularly excellent softness imparted to the finished fabric material as well as versatility thereof relative to the kinds of the fibers forming the fabric material. While the aminoalkyl groups contained in the aminoalkyl-containing organopolysiloxanes are not particularly limitative, the aminoalkyl groups of the most preferred types include 3-aminopropyl group of the formula $—C_3H_6NH_2$ and 3-N-(2-aminoethyl)aminopropyl group of the formula $—C_3H_6NHCH_2CH_2NH_2$ because a fabric-finishing agent containing an organopolysiloxane having these aminoalkyl groups imparts the treated fabric material with very excellent touch feeling of softness as is taught in Japanese Patent Publications 48-1480, 54-43614 and 57-43673 and Japanese Patent Kokai 60-185679, 60-185880 and 64-61576.

Though excellent in respect of the touch feeling of softness of the treated fabric materials, the fabric-finishing agents containing an organopolysiloxane having the aminoalkyl groups of the above mentioned types are not quite satisfactory due to a very serious problem that the fabric materials finished therewith sometimes cause yellowing when subjected to a heat treatment or dried under sunlight or in the lapse of time due to degradation of the amino groups presumably by the influences of heat or ultraviolet light eventually resulting in the loss of the softness. This problem is particularly detrimental against white-colored or light-colored fabric materials.

Various attempts and proposals have been made heretofore with an object to solve the above mentioned problem due to yellowing of the fabric material finished with an aminoalkyl silicone-based fabric-finishing agent of the above mentioned types, in which the aminoalkyl-containing organopolysiloxane is modified by the reaction with an anhydride or chloride of an organic acid disclosed in Japanese Patent Kokai 57-101076, with an epoxy compound disclosed in Japanese Patent Kokai 59-179884, with a higher fatty acid disclosed in Japanese Patent Kokai 1-306683 and with a carbonate disclosed in Japanese Patent Kokai 2-47371. Modification of the aminoalkyl groups is of course not ineffective, though insufficient, to solve the problem of yellowing of the treated fabric materials but is accompanied by a decrease in the effectiveness of imparting softness and smoothness to the finished fabric materials as compared with a silicone-based fabric finishing agent containing an organopolysiloxane having unmodified aminoalkyl groups.

Besides the types of the aminoalkyl groups, another important factor which influences the usefulness of an aminoalkyl-containing organopolysiloxane as the principal ingredient in the silicone-based fabric-finishing agent is the content of the aminoalkyl groups in the organopolysiloxane. For example, the aminoalkyl-containing organopolysiloxane having 3-N-(2-aminoethyl)amino propyl groups most widely employed in he prior art fabric finishing agents has an amine equivalent in the range from 1500 to 2000 g/mole because of the highest softness imparted to the treated fabric materials. The amine equivalent here implied is the amount of the organopolysiloxane in grams giving 1 mole of the amino groups $—NH_2$ and imino groups —NH— as a total. When the amine equivalent of the aminoalkyl-containing organopolysiloxane is increased, for example, in the range from 3000 to 4000 g/mole, the trouble due to yellowing of the treated fabric materials can be dissolved to some extent though at a sacrifice of the softness imparted to the treated fabric materials.

SUMMARY OF THE INVENTION

The present invention accordingly has an object to provide a novel method for the finishing treatment of a fabric material to impart the finished fabric material with very excellent touch feeling of softness and smoothness with less significant troubles due to yellowing of the fabric material finished therewith than in the prior art.

Thus, the method of the present invention for the finishing treatment of a fabric material comprises the steps of:

(a) soaking the fabric material with a fabric-finishing liquid composition in the form of a solution or in the form of an aqueous emulsion containing an aminoalkyl-modified diorganopolysiloxane represented by the general formula $$A—SiR_2—O—(—SiR_2—O—)_p—(—SiRQ—O—)_q—SiR_2—A, \quad (I)$$

in which R is a monovalent hydrocarbon group having 1 to 20 carbon atoms, Q is an aminoalkyl group expressed by the general formula $$—R^1—(—NH—CH_2—CH_2—)_n—NH_2, \quad (II)$$

$R^1$ being a divalent hydrocarbon group having 1 to 8 carbon atoms and the subscript n being 2 or 3, A is a hydroxyl group, R, OR or Q, the subscript p is an average number in the range from 5 to 2000 and the subscript q is 0 or an average number not exceeding 100 with the proviso that q is not 0 when the groups denoted by A in a molecule are each a hydroxyl group, R or OR, and having an amine equivalent in the range from 5000 to 100,000 g/mole;

(b) drying the fabric material soaked with the fabric-finishing liquid composition to deposit the aminoalkyl-modified diorganopolysiloxane on the surface of the fibers of the fabric material; and (c) subjecting the dried fabric material to a heat treatment.

DETAILED DESCRIPTION OF THE PREFERRED EMBODIMENTS

Kinds of the fibers forming the fabric material to which the above defined inventive method is applicable are not particularly limitative including not only natural fibers such as cotton, silk, linen, wool, angora and mohair but also synthetic and semi-synthetic fibers such as polyester fibers, nylons, acrylic fibers, spandexes, rayons and cellulose acetate fibers. The form of the fabric material is also not limitative including woven fabrics, knit fabrics and non-woven fabrics as well as staples, filaments, waddings, tows and sewing threads.

In the first step (a) of the inventive method for the finishing treatment of a fabric material, the above mentioned fabric material is soaked with a fabric-finishing liquid composition of which the principal ingredient is a specific aminoalkyl-modified organopolysiloxane having a molecular structure defied in terms of the general formula (I) given above and having a specified amine equivalent.

In the general formula (I), the symbol R denotes a monovalent hydrocarbon group having 1 to 20 carbon atoms exemplified by alkyl groups such as methyl, ethyl, propyl, butyl, pentyl, hexyl, heptyl, octyl, decyl, dodecyl, tetradecyl and octadecyl groups, alkenyl groups such as vinyl and allyl groups, cycloalkyl groups such as cyclopentyl and cyclohexyl groups, aryl groups such as phenyl, tolyl and naphthyl groups and aralkyl groups such as 2-phenylethyl and 2-phenylpropyl groups as well as substituted hydrocarbon groups obtained by replacing a part or all of the hydrogen atoms in the above named hydrocarbon groups with halogen atoms. Each of the groups demoted by R can be selected from the above described groups independently from the others although it is preferable that at least 90% in number of the groups denoted by R in a molecule are methyl groups, the balance, if any, being phenyl groups.

The group denoted by Q is an aminoalkyl group expressed by the general formula (II) in which $R^1$ is a divalent hydrocarbon group having 1 to 8 carbon atoms or, preferably, an alkylene group such as methylene, dimethylene, trimethylene and tetramethylene groups or, more preferably, a trimethylene group, and the subscript n is 2 or 3. It is not required that all of the groups denoted by Q in a molecule be identical relative to the types of the group $R^1$ and the values of n. When the value of n is 0 or 1, no good touch feeling of softness can be imparted to the fabric material finished according to the inventive method while, when the value of n is 4 or larger, a trouble of yellowing sometimes occurs in the finished fabric material.

Each of the two groups A at the molecular chain ends of the diorganopolysiloxane molecule is, independently from the other, selected from the class consisting of a hydroxyl group OH, monovalent hydrocarbon groups R, hydrocarbyloxy groups OR and aminoalkyl groups Q.

The subscript p in the general formula (I) is an average number in the range from 5 to 2000 or, preferably, from 10 to 1000 or, more preferably, from 100 to 500. When the value of p is too small, the finished fabric material cannot be imparted with excellent touch feeling of softness while an aminoalkyl-modified diorganopolysiloxane of which the value of p is too large has a viscosity so high that certain disadvantages are caused in handling thereof.

The subscript q in the general formula (I) is 0 or an average number not exceeding 100 or, preferably, 0 or an average number not exceeding 50 or, more preferably, 0 or an average number not exceeding 10 with the proviso that q cannot be 0 when the two terminal groups denoted by A are each not Q or, namely, they are each a hydroxyl group, R or OR. When the value of q is too large, a trouble of yellowing is sometimes caused in the finished fabric material.

The aminoalkyl-modified diorganopolysiloxane as the principal ingredient in the fabric-finishing liquid composition used in the inventive method should have an amine equivalent in the range from 5000 to 100,000 or, preferably, from 10,000 to 50,000. The amine equivalent here implied is an amount in grams of the aminoalkyl-modified diorganopolysiloxane containing 1 mole of the amino groups —$NH_2$ and imino groups —NH— as a total. When the amine equivalent of the aminoalkyl-modifled diorganopolysiloxane is too small, a trouble of yellowing may be caused in the finished fabric material while, when the amine equivalent is too large, the finished fabric material cannot be imparted with an improved touch feeling of sufficient softness.

Particular examples of the aminoalkyl-modified diorganopolysiloxane suitable as the principal ingredient in the fabric-finishing liquid composition include those compounds expressed by the following structural formulas (1) to (10), in which Me is a methyl group, $Q^2$ is an aminoalkyl group of the formula —$C_3H_6$—(—NH—$CH_2$—$CH_2$—)$_2$—$NH_2$, $Q^3$ is an aminoalkyl group of the formula —$C_3H_6$—(—NH—$CH_2$—$CH_2$—)$_3$—$NH_2$, and the subscripts p and q each have the values defined above and selected to satisfy the requirement for the specified amine equivalent of the aminoalkyl-modified diorganopolysiloxane:

(1) $Me_3Si—O—(SiMe_2—O)_p—(SiMeQ^2—O)_q—SiMe_3$;

(2) $MeO—SiMe_2—O—(SiMe_2—O)_p—(SiMeQ^2—O)_q—SiMe_2—OMe$;

(3) $HO—SiMe_2—O—(SiMe_2—O)_p—(SiMeQ^2—O)_q—SiMe_2—OH$;

(4) $Q^2—SiMe_2—O—(SiMe_2—O)_p—(SiMeQ^2—O)_q—SiMe_2—Q^2$;

(5) $Q^2—SiMe_2—O—(SiMe_2—O)_p—(SiMe_2—O)_q—SiMe_2—Q^2$;

(6) $Me_3Si—O—(SiMe_2—O)_p—(SiMeQ^3—O)_q—SiMe_3$;

(7) $MeO—SiMe_2—O—(SiMe_2—O)_p—(SiMeQ^3—O)_q—SiMe_2—OMe$;

(8) $HO—SiMe_2—O—(SiMe_2—O)_p—(SiMeQ^3—O)_q—SiMe_2—OH$;

(9) $Q^3—SiMe_2—O—(SiMe_2—O)_p—(SiMeQ^3—O)_q—SiMe_2—Q^3$; and

(10) $Q^3—SiMe_2—O—(SiMe_2—O)_p—(SiMe_2—O)_q—SiMe_2—Q^3$.

The aminoalkyl-modified diorganopolysiloxane described above can be synthesized according to a known procedure disclosed in U.S. Pat. No. 5,212,274 and elsewhere. For example, an aminoalkyl methyl dimethoxy silane of the formula $(MeO)_2MeSiQ$, in which each symbol has the same meaning as defined before, is synthesized by the reaction of a chloroalkyl dimethoxy methyl silane of the formula $ClR^1Si(OMe)_2Me$, $R^1$ having the same meaning as defined before, and diethylenetriamine or triethylenetetramine and the aminoalkyl methyl dimethoxy silane of the formula $(MeO)_2MeSiQ$ or a hydrolysis-condensation product thereof is subjected to a siloxane-rearrangement equilibration reaction at an elevated temperature in the presence of a catalytic compound such as alkali metal hydroxides, tetramethylammonium hydroxide and tetrabutylphosphonium hydroxide with other source materials of dimethylsiloxane units or trimethylsiloxy groups such as hexamethyldisiloxane, α,ω-dihydroxy dimethylpolysiloxane, dimethoxy dimethyl silane, trimethyl methoxy silane and octamethyl cyclotetrasiloxane. It is optional that the thus prepared diorganopolysiloxane has a small amount of branched siloxane units. The diorganopolysiloxane can further be modified by the reaction with an organic acid, inorganic acid, organic acid anhydride, carbonate compound and epoxy compound.

The above described aminoalkyl-modified diorganopolysiloxane is used in the fabric-finishing treatment according to the invention in the form of a solution in an organic solvent or, preferably, in the form of an aqueous emulsion as the fabric-finishing liquid composition. When the liquid composition is a solution, the solution is prepared by dissolving the aminoalkyl-modified diorganopolysiloxane in an organic solvent such as toluene, xylene, n-hexane, n-heptane, methyl ethyl ketone, methyl isobutyl ketone, ethyl acetate, butyl acetate and mineral terpene, either singly or as a mixture of two kinds or more, in an appropriate concentration.

When the liquid composition is an aqueous emulsion, the aminoalkyl-modified diorganopolysiloxane is emulsified in water containing a surface active agent, which is not particularly limitative including non-ionic surface active agents such as polyoxyethylene alkyl ethers, polyoxyethylene alkylphenyl ethers, sorbitan alkylates and polyoxyethylene sorbitan alkylates, anionic surface active agents such as alkylbenzene sulfonates and alkyl phosphates, cationic surface active agents such as quaternary ammonium salts and salts of alkylamines and amphoteric surface active agents such as alkylbetaines and alkylimidazolines. The amount of the surface active agent used as an emulsifying agent of the aminoalkyl-modifled diorganopolysiloxane in an aqueous medium is in the range from 5 to 50 parts by weight or, preferably, from 10 to 30 parts by weight per 100 parts by weight of the siloxane ingredient. The amount of water as the emulsification medium is not particularly limitative but it is advantageous that the amount of water is so adjusted that the resultant aqueous emulsion contains from 5 to 60% by weight or, preferably, from 10 to 40% by weight of the siloxane compound although the actual finishing treatment of a fabric material is conducted with a further diluted aqueous emulsion containing the organopolysiloxane ingredient. The procedure for the emulsification of the organopolysiloxane compound is conventional by vigorously agitating the organopolysiloxane compound and water containing a surface active agent by using a suitable mixing machine such as homomixers, homogenizers, colloid mills and line mixers.

It is of course optional that the fabric-finishing liquid composition used in the inventive method is further admixed, besides the aminoalkyl-modified diorganopolysiloxane as the principal ingredient, with various kinds of known additives conventionally used in fabric-finishing agents such as anticrease agents, flame retardants, antistatic agents and heat resistance improvers.

In step (a) of the inventive method, the fabric material for the finishing treatment is soaked with a liquid composition prepared by diluting the above described organic solution or aqueous emulsion of the aminoalkyl-modified diorganopolysiloxane. The concentration of the diorganopolysiloxane in the liquid composition with which the fabric material is soaked is not particularly limitative but is usually in the range from 0.1% to 5% by weight so that the pick-up amount of the diorganopolysiloxane by the fabric material may be in the range from 0.01 to 10% by weight depending on the kind of the fibers forming the fabric material assuming an appropriate squeeze ratio. Soaking of the fabric material with the liquid composition can be performed by any conventional means such as dipping, spray coating and roller coating. When the method of dipping is undertaken, the fabric material is immersed and kept in the treatment bath for 1 to 5 minutes and then pulled up from the bath followed by squeezing, if necessary.

In step (b) of the inventive method, the fabric material soaked with the liquid composition containing the aminoalkyl-modified diorganopolysiloxane is then, after squeezing, if necessary to adjust the pick-up amount of the organopolysiloxane on the fabric material, dried by blowing with hot air or by keeping in a hot-air drying oven at a temperature in the range from 100 to 150° C.

In step (c) of the inventive method, the dried fabric material obtained in step (b) above, in which the aminoalkyl-modified diorganopolysiloxane is deposited on the surface of the fibers, is subjected to a heat treatment at a temperature of 150° C. or higher or, for example, at 200° C., the upper limit of the temperature depending on the heat stability of the fibers forming the fabric material, for 2 to 5 minutes so as to complete the finishing treatment of the fabric material according to the inventive method. The thus finished fabric material is imparted with a touch feeling of excellent softness and smoothness with a greatly decreased degree of yellowing as compared with the fabric materials finished by the treatment with a conventional aminoalkyl-modified diorganopolysiloxane.

In the following, the method of the invention is illustrated in more detail by way of Examples and Comparative Examples as preceded by a description of the preparation procedure for several aminoalkyl-modified diorganopolysiloxanes, referred to as the aminoalkyl siloxanes 1 to 6 hereinafter. In the following, the terms of "%" and "parts" always refer to "% by weight" and "parts by weight", respectively, and the values of viscosity are all those obtained by the measurement at 25° C.

Preparation of aminoalkyl siloxane 1.

Into a flask of 500 ml capacity equipped with a stirrer, thermometer, reflux condenser and gas inlet tube were introduced 122 g of 3-chloropropyl methyl dimethoxy silane which was agitated and heated up to a temperature of 70° C. under a stream of nitrogen gas. The silane compound in the flask was admixed dropwise with 206 g of diethylenetriamine at the same temperature. After completion of the dropwise addition of diethylenetriamine, the temperature of the reaction mixture in the flask was increased to 110° C. where the reaction mxture was further agitated for 3 hours to effect the dehydrochlorination reaction. The reaction mixture thus obtained was subjected to distillation under reduced pressure to obtain 196 g of a fraction boiling at 132° C. under a pressure of 2 Torr, which could be identified to be an aminoalkyl dimethoxy methyl silane of the formula $(MeO)_2MeSiC_3H_6(NHCH_2CH_2)_2NH_2$ in a gas-chromatographic purity of 97%.

A 60 g portion of the above obtained aminoalkyl dimethoxy methyl silane was taken in a flask of 500 ml capacity and 13 g of water were added thereinto dropwise under agitation followed by further continued agitation for 3 hours at room temperature to effect the hydrolysis-condensation reaction of the silane compound. Thereafter, 30 g of toluene were added to the reaction mixture in the flask and the free water in the reaction mixture was removed by azeotropic distillation followed by removal of toluene to give 54 g of a highly viscous, clear product, which is referred to as the hydrolyzate I hereinafter.

Into a flask of 1000 ml capacity equipped with a stirrer, thermometer, reflux condenser and gas inlet tube were introduced 680 g of octamethyl cyclotetrasiloxane, 40 g of dodecamethyl pentasiloxane and 5 g of the hydrolyzate I obtained above. The mixture in the flask was agitated under a stream of nitrogen gas and heated up to a temperature of 110° C. where the mixture was admixed with 0.4 g of tetrabutylphosphonium hydroxide as a catalyst and agitation was continued for further 5 hours to effect the siloxane-rearrangement equilibration reaction followed by further continued heating at 150° C. for 1 hour to obtain 620 g of a reaction product.

The thus obtained reaction product was a clear and colorless oily liquid having a viscosity of 830 centistokes and an amine equivalent of 10,500 g/mole, which was assumedly an aminoalkyl-modifled dimethylpolysiloxane, referred to as the aminoalkyl siloxane 1 hereinafter, expressed by the following average structural formula:

$$Me_3Si—O—(—SiMe_2—O—)_{200}—(—SiMeQ^2—O—)_{0.5}—SiMe_3,$$

in which each symbol has the same meaning as defined before.

Preparation of aminoalkyl siloxane 2.

The procedure for the preparation of a second aminoalkyl-modified dimethylpolysiloxane, referred to as the aminoalkyl siloxane 2 hereinafter, was substantially the same as in the preparation of the aminoalkyl siloxane 1 described above excepting for a decrease of the amount of the hydrolyzate I from 5 g to 2.5 g to obtain 625 g of a clear and colorless oily liquid having a viscosity of 800 centistokes and an amine equivalent of 19,000 g/mole. This aminoalkyl siloxane 2 could be expressed by an average structural formula $$Me_3Si—O—(—SiMe_2—O—)_{200}—(—SiMeQ^2—O—)_{0.25}—SiMe_3,$$

in which each symbol has the same meaning as defined before.

Preparation of aminoalkyl siloxane 3.

The procedure for the preparation of a third aminoalkyl-modified dimethylpolysiloxane, referred to as the aminoalkyl siloxane 3 hereinafter, was substantially the same as in the preparation of the aminoalkyl siloxane 1 described above excepting for a decrease of the amount of the hydrolyzate I from 5 g to 1.0 g to obtain 615 g of a clear and colorless oily liquid having a viscosity of 810 centistokes and an amine equivalent of 40,400 g/mole. This aminoalkyl siloxane 3 could be expressed by an average structural formula $$Me_3Si—O—(—SiMe_2—O—)_{200}—(—SiMeQ^2—O—)_{0.1}—SiMe_3,$$

in which each symbol has the same meaning as defined before.

Preparation of aminoalkyl siloxane 4.

An aminoalkyl-containing organosilane expressed by the formula $(MeO)_2MeSiC_3H_6(NHCH_2CH_2)_3NH_2$ was synthesized in substantially the same manner as described in Preparation of aminoalkyl siloxane 1 described above excepting for the use of 100 g of 3-chloropropyl methyl dimethoxy silane and 239 g of triethylenetetramine as the starting materials although, since the product silane compound had a very high boiling point and could hardly be distilled, the reaction mixture after completion of the reaction was used as the starting material of the hydrolysis reaction only after stripping of the unreacted triethylenetetramine. Thus, 60 g of the aminoalkyl silane after removal of triethylenetetramine were subjected to the hydrolysis-condensation reaction in substantially the same manner as in the preparation of the hydrolyzate I to give 51 g of a highly viscous oily product, referred to as the hydrolyzate II hereinafter.

A fourth aminoalkyl-modified dimethylpolysiloxane, referred to as the aminoalkyl siloxane 4 hereinafter, was prepared in substantially the same manner as in the preparation of the aminoalkyl siloxane 1 described above excepting for the use of 680 g of octamethyl cyclotetrasiloxane, 40 g of dodecamethyl pentasiloxane and 1 g of the hydrolyzate II prepared as above as the starting materials to give 630 g of a clear and colorless oily liquid product having a viscosity of 820 centistokes and an amine equivalent of 32,000 g/mole. This aminoalkyl siloxane 4 could be expressed by the average structural formula $$Me_3Si—O—(—SiMe_2—O—)_{200}—(—SiMeQ^3—O—)_{0.1}—SiMe_3,$$

in which each symbol has the same meaning as defined before.

Preparation of aminoalkyl siloxane 5.

The procedure for the preparation of a fifth aminoalkyl-modified dimethylpolysiloxane, referred to as the aminoalkyl siloxane 5 hereinafter, was substantially the same as in the preparation of the aminoalkyl siloxane 1 described above excepting for an increase of the amount of the hydrolyzate I from 5 g to 13 g to obtain 620 g of a clear and colorless oily liquid having a viscosity of 810 centistokes and an amine equivalent of 3500 g/mole. This aminoalkyl siloxane 5 could be expressed by an average structural formula $$Me_3Si—O—(—SiMe_2—O—)_{200}—(—SiMeQ^2—O—)_{1.3}—SiMe_3,$$

in which each symbol has the same meaning as defined before.

Preparation of aminoalkyl siloxane 6.

The procedure for the preparation of a sixth aminoalkyl-modified dimethylpolysiloxane, referred to as the aminoalkyl siloxane 6 hereinafter, was substantially the same as in the preparation of the aminoalkyl siloxane 1 described above excepting for a decrease of the amount of the hydrolyzate I from 5 g to 0.4 g to obtain 600 g of a clear and colorless oily liquid having a viscosity of 800 centistokes and an amine equivalent of 120,000 g/mole. This aminoalkyl siloxane 6 could be expressed by an average structural formula $$Me_3Si—O—(—SiMe_2—O—)_{200}—(—SiMeQ^2—O—)_{0.04}—SiMe_3,$$

in which each symbol has the same meaning as defined before.

EXAMPLE 1

An aqueous emulsion of the aminoalkyl siloxane 1, referred to as the emulsion 1 hereinafter, was prepared by emulsifying, using a homomixer, 300 g of the aminoalkyl siloxane 1 together with 30 g of a polyoxyethylene (10 moles addition of ethylene oxide) alkyl ether having an HLB value of 13.7 in 670 g of water followed by a secondary emulsification treatment through a high-pressure homogenizer.

This emulsion 1 was diluted with addition of water to have a content of the aminoalkyl siloxane 1 of 0.5% to prepare a diluted working emulsion to serve as a fabric treatment bath.

Testing cloth specimens, which were a mixed-spun broad cloth of polyester and cotton fibers for the test of softness of the treated cloth and a cotton broad cloth after treatment with a fluorescent dye for the test of yellowing, were dipped for 5 minutes in the treatment emulsion followed by roll-squeezing in a squeezing ratio of 100%. The thus squeezed cloths were dried by heating at 100° C. for 2 minutes and then subjected to a heat treatment at 150° C. for 2 minutes. While the softness test was undertaken for the cloth specimen after this 150° C. treatment, the accelerated yellowing test was undertaken for the cloth specimen after a further heat treatment at 200° C. for 2 minutes.

The evaluation tests of these treated cloth specimens for the softness and yellowing were undertaken in the following manner and the results are shown in Table 1 below, which shows also the results of the control tests undertaken with the same test cloths before the aminoalkyl siloxane treatment.

Softness of treated cloth:

An organoleptic test by hand touching was conducted by three panel members 1, 2 and 3 to record the results in three ratings of: "A" for excellent softness, "B" for good softness and "C" for poor softness.

Yellowing of treated cloth:

Yellowness of the treated cloths was given by the b value in the colorimetric system as determined by using a calorimetric color-difference meter (Model ZE 2000, manufactured by Nippon Denshoku Kogyo Co.). A larger b value, i.e. a smaller absolute value of b, means higher yellowness of the treated cloth.

EXAMPLE 2

The procedures were substantially the same as in Example 1 described above for the preparation of the working emulsion for fabric treatment, treatment of the test cloths and evaluation of the treated cloths excepting for the replacement of the aminoalkyl siloxane 1 with the same amount of the aminoalkyl siloxane 2. The results of the evaluation tests are shown in Table 1.

EXAMPLE 3

The procedures were substantially the same as in Example 1 described above for the preparation of the working emulsion, treatment of the test cloths and evaluation of the treated cloths excepting for the replacement of the aminoalkyl siloxane 1 with the same amount of the aminoalkyl siloxane 3. The results of the evaluation tests are shown in Table 1.

EXAMPLE 4

The procedures were substantially the same as in Example 1 described above for the preparation of the working emulsion, treatment of the test cloths and evaluation of the treated cloths excepting for the replacement of the aminoalkyl siloxane 1 with the same amount of the aminoalkyl siloxane 4. The results of the evaluation tests are shown in Table 1.

COMPARATIVE EXAMPLE 1

The procedures were substantially the same as in Example 1 described above for the preparation of the working emulsion, treatment of the test cloths and evaluation of the treated cloths excepting for the replacement of the aminoalkyl siloxane 1 with the same amount of another aminoalkyl siloxane having an amine equivalent of 1800 g/mole and expressed by the average structural formula $$Me_3Si—O—(—SiMe_2—O—)_{200}—[—SiMe(C_3H_6NHCH_2CH_2NH_2)—O—]_4—SiMe_3,$$

in which Me is a methyl group. The results of the evaluation tests are shown in Table 1.

COMPARATIVE EXAMPLE 2

The procedures were substantially the same as in Example 1 described above for the preparation of the working emulsion, treatment of the test cloths and evaluation of the treated cloths excepting for the replacement of the aminoalkyl siloxane 1 with the same amount of the aminoalkyl siloxane 5. The results of the evaluation tests are shown in Table 1.

COMPARATIVE EXAMPLE 3

The procedures were substantially the same as in Example 1 described above for the preparation of the working emulsion, treatment of the test cloths and evaluation of the treated cloths excepting for the replacement of the aminoalkyl siloxane 1 with the same amount of the aminoalkyl siloxane 6. The results of the evaluation tests are shown in Table 1.

TABLE 1

| | Softness panel member | | | |
|---|---|---|---|---|
| | 1 | 2 | 3 | Yellowness |
| Example 1 | A | A | A | −6.4 |
| Example 2 | A | A | A | −6.5 |
| Example 3 | A | A–B | A | −6.6 |
| Example 4 | A | A | A | −6.6 |
| Comparative Example 1 | B | A–B | B | −5.5 |
| Comparative Example 2 | A | A | A | −5.4 |
| Comparative Example 3 | B | B–C | B | −6.4 |
| Control | C | C | C | −6.7 |

What is claimed is:

1. A method for the finishing treatment of a fabric material which comprises the steps of:

(a) soaking the fabric material with a fabric-finishing liquid composition in the form of a solution or in the form of an aqueous emulsion containing an aminoalkyl-modified diorganopolysiloxane represented by the general formula $$A—SiR_2—O—(—SiR_2—O—)_p—(—SiRQ—O—)_q—SiR_2—A,$$

in which R is a monovalent hydrocarbon group having 1 to 20 carbon atoms, Q is an aminoalkyl group expressed by the general formula $$—R^1—(—NH—CH_2—CH_2—)_n—NH_2,$$

$R^1$ being a divalent hydrocarbon group having 1 to 8 carbon atoms and the subscript n being 2 or 3, A is a hydroxyl group, R, OR or Q, the subscript p is an average number in the range from 5 to 2000 and the subscript q is 0 or an average number not exceeding 100 with the proviso that q is not 0 when the groups denoted by A in a molecule are each a hydroxyl group, R or OR, and having an amine equivalent in the range from 5000 to 100,000 g/mole;

(b) drying the fabric material soaked with the fabric-finishing liquid composition to deposit the aminoalkyl-modified diorganopolysiloxane on the surface of the fibers of the fabric material; and (c) subjecting the dried fabric material to a heat treatment at a temperature of 150° C. or higher.

2. The method for the finishing treatment of a fabric material as claimed in claim 1 in which the subscript n in the general formula representing Q is 2.

3. The method for the finishing treatment of a fabric material as claimed in claim 1 in which the group denoted by R is a methyl group.

4. The method for the finishing treatment of a fabric material as claimed in claim 1 in which the group denoted by $R^1$ is a trimethylene group.

5. The method for the finishing treatment of a fabric material as claimed in claim 1 in which the subscript p in the general formula representing the aminoalkyl-modified diorganopolysiloxane is a number having an average value in the range from 10 to 1000.

6. The method for the finishing treatment of a fabric material as claimed in claim 5 in which the subscript p in the general formula representing the aminoalkyl-modified diorganopolysiloxane is a number having an average value in the range from 100 to 500.

7. The method for the finishing treatment of a fabric material as claimed in claim 1 in which the subscript q in the general formula representing the aminoalkyl-modified diorganopolysiloxane is 0 or a number having an average value not exceeding 50.

8. The method for the finishing treatment of a fabric material as claimed in claim 7 in which the subscript q in the general formula representing the aminoalkyl-modified diorganopolysiloxane is 0 or a number having an average value not exceeding 10.

9. The method for the finishing treatment of a fabric material as claimed in claim 1 in which the aminoalkyl-modified diorganopolysiloxane has an amine equivalent in the range from 10,000 to 50,000 g/mole.

10. The method for the finishing treatment of a fabric material as claimed in claim 1 in which the fabric-finishing liquid composition is in the form of an aqueous emulsion containing the aminoalkyl-modified diorganopolysiloxane dispersed in an aqueous medium.

11. The method for the finishing treatment of a fabric material as claimed in claim 10 in which the aqueous emulsion contains from 5 to 50 parts by weight of a surface active agent per 100 parts by weight of the aminoalkyl-modified diorganopolysiloxane.

12. The method for the finishing treatment of a fabric material as claimed in claim 1 in which the amount of the aminoalkyl-modified diorganopolysiloxane deposited on the surface of the fibers of the fabric material in step (b) is in the range from 0.01 to 10% by weight based on the amount of the fabric material.

13. The method for the finishing treatment of a fabric material as claimed in claim 1 in which the heat treatment in step (c) is performed for 2 to 5 minutes.

14. A method according to claim 1, wherein R in each case is alkyl, halogen-substituted alkyl, alkenyl, halogen-substituted alkenyl, cycloalkyl, halogen-substituted cycloalkyl, aryl, halogen-substituted aryl, aralkyl or halogen-substituted aralkyl, and $R^1$ is alkylene.

15. A method according to claim 1, wherein at least 90% of the R groups are methyl and the balance, if any, are phenyl.

16. A method according to claim 14, wherein R, in each case, is methyl, ethyl, propyl, butyl, pentyl, hexyl, heptyl, octyl, decyl, dodecyl, tetradeyl, octadecyl, vinyl, allyl, cyclopentyl, cyclohexyl, phenyl, tolyl, naphthyl, 2-phenylethyl, or 2-phenylpropyl, and $R^1$ is methylene, dimethylene, trimethylene, or tetramethylene.

17. A method according to claim 1, wherein said aminoalkyl-modified diorganopolysiloxane is selected from formulas 1 to 10:

(1) $Me_3Si—O—(SiMe_2—O)_p—SiMeQ^2—O)_q—SiMe_3$;
(2) $MeO—Si—O—(SiMe_2—O)_p—SiMeQ^2—O)_q—SiMe_2—OMe$;
(3) $HO—SiMe_2—O—(SiMe_2—O)_p—(SiMeQ^2—O)_p—SiMe_2—OH$;
(4) $Q^2—SiMe_2—O—(SiMe_2—O)_p—(SiMeQ^2—O)_p—SiMe_2—Q^2$;
(5) $Q^2—SiMe_2—O—(SiMe_2—O)_p—(SiMe_2—O)_p—SiMe_2—Q^2$;
(6) $Me_3Si—O—(SiMe_2—O)_p—(SiMeQ^3—O)_p—SiMe_3$;
(7) $MeO—Si—O—(SiMe_2—O)_p—SiMeQ^2—O)_q—SiMe_2—OMe$;
(8) $HO—SiMe_2—O—(SiMe_2—O)_p—(SiMeQ^2—O)_p—SiMe_2—OH$;
(9) $Q^3—SiMe_2—O—(SiMe_2—O)_p—(SiMeQ^2—O)_p—SiMe_2—Q^3$; and
(10) $Q^3—SiMe_2—O—(SiMe_2—O)_p—(SiMe_2—O)_p—SiMe_2—Q^3$;

wherein Me is methyl, $Q^2$ is $—C_3H_6—(—NH—CH_2—CH_2—)_2—NH_2$, and $Q^3$ is $—C_3H_6—(—NH—CH_2—CH_2—)_3—NH_2$.

* * * * *